US005150651A

United States Patent [19]

Flores

[11] Patent Number: 5,150,651

[45] Date of Patent: Sep. 29, 1992

[54] DOCTOR-BLADE ASSEMBLY FOR FLEXOGRAPHIC PRESS

[76] Inventor: Carlos R. Flores, 931 Craven Dr., Suisun City, Calif. 94585

[21] Appl. No.: 712,570

[22] Filed: Jun. 10, 1991

[51] Int. Cl.[5] ..... B41F 31/06

[52] U.S. Cl. ..... 101/207; 101/366; 403/23; 403/50

[58] Field of Search ..... 101/157, 169, 207, 208, 101/210, 350, 363, 364, 366; 118/259, 261, 407, 410; 403/23, 50, 51, 134

[56] References Cited

U.S. PATENT DOCUMENTS

| | | | |
|---|---|---|---|
| 1,591,342 | 7/1926 | Stone | 403/23 |
| 3,135,197 | 6/1964 | Dutro et al. | 101/364 |
| 3,585,932 | 6/1971 | Granger | 101/169 |
| 4,513,662 | 4/1985 | Schneider | 101/207 |
| 4,590,855 | 5/1986 | Schommer et al. | 101/157 |
| 4,605,227 | 8/1986 | Hurd et al. | 403/104 |
| 4,738,879 | 4/1988 | Williams | 118/259 |
| 4,796,528 | 1/1989 | Sarazen | 101/208 |
| 4,798,122 | 1/1989 | Gisler et al. | 84/330 |
| 4,945,832 | 8/1990 | Odom | 101/364 |
| 4,967,609 | 11/1990 | Takagi et al. | 403/50 |
| 5,012,736 | 5/1991 | Van Kanegan et al. | 101/207 |

*Primary Examiner*—Edgar S. Burr
*Assistant Examiner*—Stephen R. Funk
*Attorney, Agent, or Firm*—Bielen, Peterson & Lampe

[57] ABSTRACT

An improved doctor-blade assembly for a flexographic press having an ink metering roller, in which the doctor-blade assembly includes an ink fountain having elastomer seals to improve end sealing of the ink fountain and to improve division of the fountain into discrete sections without cross bleed of different inks, and in which the assembly includes protective guard boots on an actuating mechanism that displaces the ink fountain into operating position with an ink metering roller to prevent crusting of ink in the actuating mechanism, affecting alignment of the assembly in the operating position.

18 Claims, 3 Drawing Sheets

DOCTOR-BLADE ASSEMBLY FOR FLEXOGRAPHIC PRESS

BACKGROUND OF THE INVENTION

This invention relates to an improved doctor-blade assembly for a flexographic press. A flexographic press is a roll press used for imprinting images using a quick-drying ink in a continuous feed process. Flexographic printing utilizes an ink-metering roller that picks up ink from an ink pan and transfers a metered quantity of ink to a plate cylinder with image areas in relief. The plate cylinder transfers the image to a substrate that passes between the plate cylinder and an impression cylinder that backs up and supports the substrate as it contacts the printing plate. The contact pressure must be precisely adjusted such that the contact point or nip between the two cylinders provides a "kiss" impression that transfers the ink to the substrate.

The ink metering roller, also called the anilox roll, has a surface that is engraved with tiny uniform cells or pockets that carry and deposit a thin uniform ink film onto the plate cylinder. In some configurations of a flexographic press, the ink is metered to the anilox roll by a separate fountain roll that picks up the ink from the ink pan and transfers it to the anilox roll in a contact transfer that squeezes out excess ink, which returns to the ink supply pan. In more modern configurations, the anilox roll serves as the dual function of a fountain roll and metering roller by use of a doctor blade, which is an elongated metal blade or knife that shaves excess ink off the anilox roll, leaving only ink in the recess cells.

For color printing, a press station having a separate ink tray, anilox roll, plate cylinder, and impression cylinder is required for each color ink used for the final composite work. Flexographic printing has certain advantages that make it useful in product packaging where a variety of different composition substrates are employed, or more recently, in newspaper printing where water-base inks are utilized to produce newsprint that does not rub off on the hands of the reader.

Flexographic presses are generally large in size and the plate cylinder frequently carries multiple plates for a single printing run. It is, therefore, advantageous to split the ink fountain tray into sections for inking with different color or different composition inks. Frequently, flexographic presses are installed with an ink fountain tray that is divided into two equal sections. Conventional means for dividing the fountain tray utilize a laminated fountain splitter. The laminated fountain splitter has a closed cell foam backing to provide contact pressure from compression, a stiff arcuate substrate and a TEFLON (tetrafluoroethylene contact surface. The TEFLON wiping surface fails to prevent cross-bleed of inks and ultimately results in excessive scoring of the anilox roll. Replacement of the anilox roll is both time consuming and expensive.

The improved doctor-blade assembly of this invention includes features that assist in maintaining proper alignment of the ink fountain tray and sealing of the fountain tray with the anilox roll when the fountain tray is moved into place. Furthermore, the ink fountain in the doctor-blade assembly of this invention utilizes a fountain splitter of improved design that inhibits cross-bleed and eliminates scoring or excess wear on the anilox roll. While the term, doctor-blade assembly, has been used in the art to define only the assembly of the customary two opposed doctor blades and their attachment means to an ink fountain, in this specification the doctor-blade assembly includes the ink fountain, the doctor-blade sub-assembly and the actuating mechanism connecting the ink fountain to the press unit.

SUMMARY OF THE INVENTION

The improved doctor-blade assembly of this invention is constructed with an ink fountain of conventional design, having adapted thereto improved end seals for eliminating ink leakage from between the end of the anilox roll and the fountain, resulting in ink slinging that can coat components with fast-drying ink, causing maladjustments. In addition, the improved doctor-blade assembly includes an improved fountain splitter that is designed to prevent excess wear on the anilox roll and to prevent bleed between sections divided by the fountain splitter. The reservoir tray of the ink fountain can be fitted with multiple fountain splitters to divide the anilox roll into as many separate inking sections as desired. Finally, the improved doctor-blade assembly includes protective boots on the actuating mechanism that supports the ink fountain and moves the doctor-blade assembly into operating position against the anilox roll.

The fountain splitter and end seals are fabricated of a similar elastomer to provide a squeegee-type action against the anilox roll instead of a traditional wiping action. The material is readily deformable and compatible with conventional ink solvents, such that the solvent acts as a lubricant between the contact face of the fountain end seals or fountain splitter to minimize friction and inhibit ink buildup and prevent wear of the dimpled surface of the anilox roll.

Because the anilox roll must be uniformly coated with ink for transfer to the plate cylinder, accurate positioning of the doctor-blade assembly against the anilox roll is critical for even distribution of ink on wiping by the mounted doctor blade. Exposure of the elbow joint of the actuating mechanism that moves the doctor-blade assembly into position against the anilox roll results in misalignment through ink buildup on the limit stop surface. While elimination of ink slinging by improved end seals reduces fouling of the actuator joint, protection of the joint by the boot guard prevents any vagrant ink from seal leakage, roll slinging, operator spills, or other sources from access to the stop surfaces used for delimiting the movement of the actuator mechanism.

These and other features of the improved doctor-blade assembly will become apparent from a detailed consideration of the preferred embodiment disclosed herein.

DESCRIPTION OF THE PREFERRED EMBODIMENTS

Figure 1:
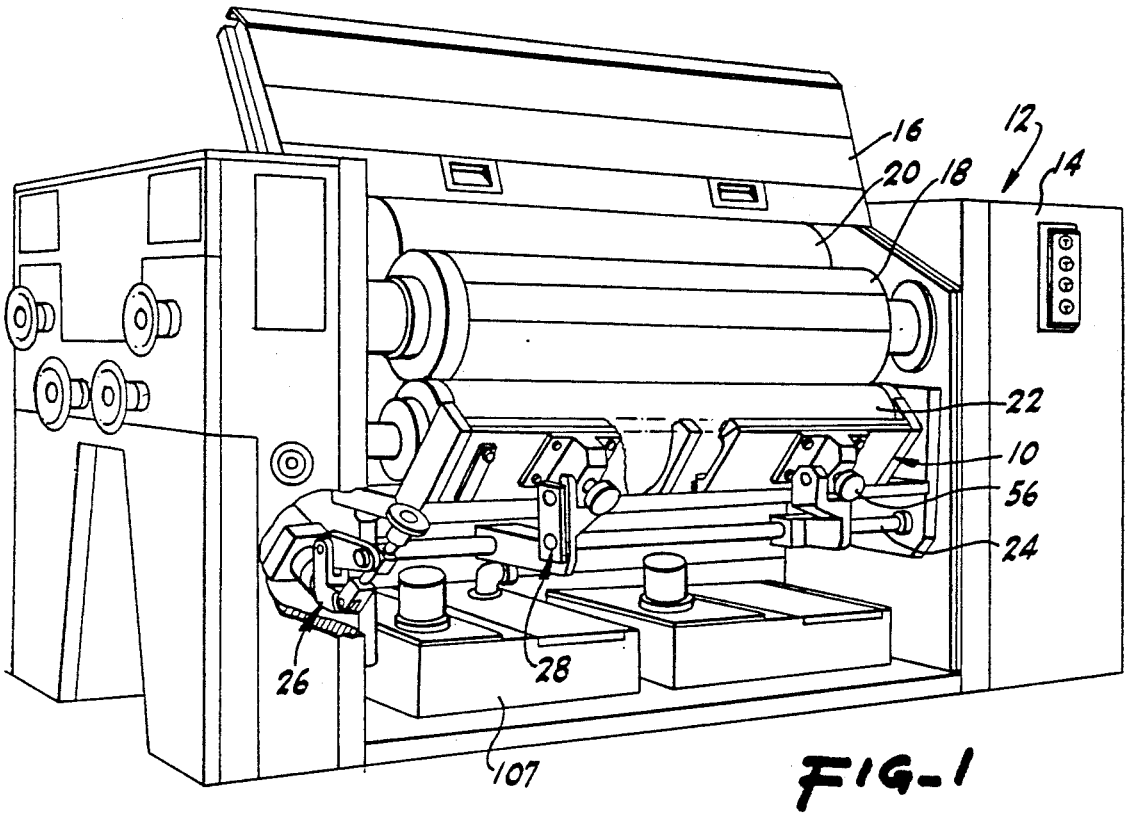
FIG. 1 is a perspective view of a flexographic press incorporating the doctor-blade assembly of this invention.

The improved doctor-blade assembly, designated generally by the reference numeral 10, is shown in FIG. 1 as one of the operable components of a flexographic press 12. The flexographic press 12 is of typical design with a single inking station visible in FIG. 1. The flexographic press 12 has a housing 14 with a front cover 16 retracted to expose a plate cylinder 18 which carries image plates (not shown) and an impression cylinder 20 that provides the backup to a substrate (not shown) that feeds between the plate cylinder and impression cylinder and on which inked images are imparted from the image plates on the plate cylinder. The doctor-blade assembly 10 is positioned against an anilox roll 22 and is mounted on a cross axle 24 that is angularly pivotable for maintenance. The cross axle 24 is accurately adjustable in angular orientation by a doctor blade adjustment mechanism 26 for precise positioning of the doctor-blade assembly 10 against the anilox roll 22.

The doctor-blade assembly 10 includes a pair of actuator arms 28 mounted at one end to the pivot axle 24 and at the other end to an ink fountain 30. The ink fountain 30 includes an elongated tray 31 having a base 32 with raised sides 34 forming an interior ink reservoir or chamber 36. The raised sides 34 have a sloped mounting lip 38 on which are positioned a doctor-blade subassembly 40 including opposed doctor blades 42 secured by a clamp bar 44 and retaining bolts 46 as shown in greater detail in FIG. 4. The projecting doctor blades have a chamfered edge that contacts the rotating anilox roll when the actuator arms move the ink fountain into juxtaposition with the anilox roll. One blade edge is in contact with the anilox roll at a time to shave off ink, that is not in the recesses of the roll. The other blade edge is proximate the surface of the roll and acts as a dam to maintain ink in the fountain.

Figure 2:
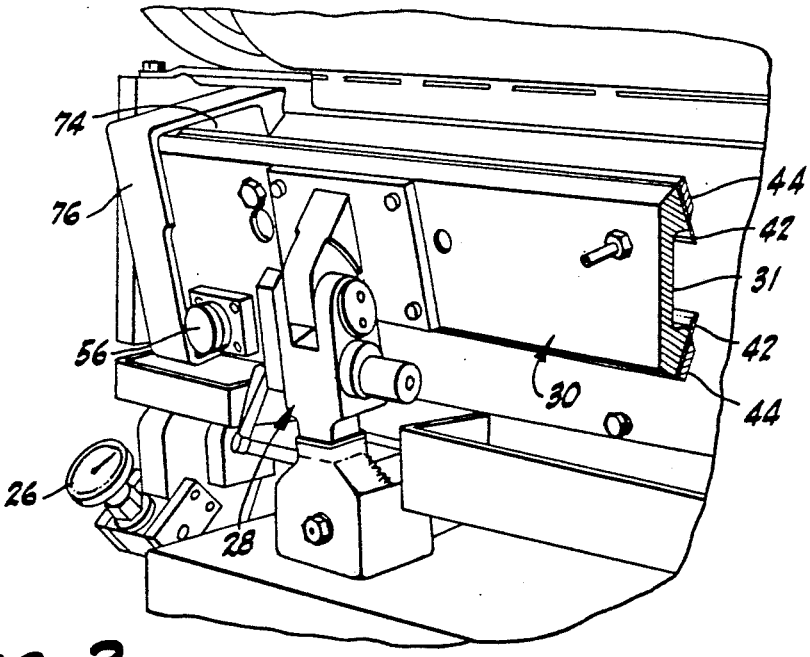
FIG. 2 is an enlarged perspective view of the doctor-blade assembly of FIG. 1, partially fragmented to show the central fountain splitter and boot guard.

The actuator arms 28 are constructed with two members 48 and 50 that articulate at an elbow joint 52 having a limit stop surface 54 that accurately positions the distal member 50 with respect to the axle-connected member 48. Any ink buildup at this contact surface 54 will result in disorientation of the distal member 50 with respect to the axle member 48, thereby causing a misalignment. Where buildup at the contact surface of one elbow at one end of the adjustment axle is different than the buildup on the other elbow surface, slight skewing of the doctor-blade assembly can occur. Although each actuator arm 28 has an individual adjustment mechanism 56, as shown in FIG. 2, for compensation of misalignments, readjustment, particularly during the processing of a job, will result in slight inconsistencies in the final printed product. To prevent vagrant ink from access to this important elbow joint 52, a protective guard boot 58, is installed over the elbow joint 52 and secured by VELCRO (hook and pile) straps 60.

Figure 4:
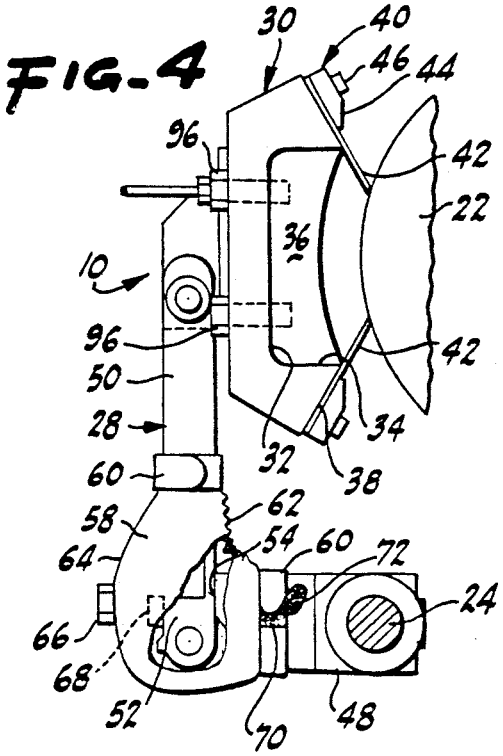
FIG. 4 is a side elevational view of the actuating mechanism for the doctor-blade assembly, showing the fountain splitter and guard boot.
Figure 6:
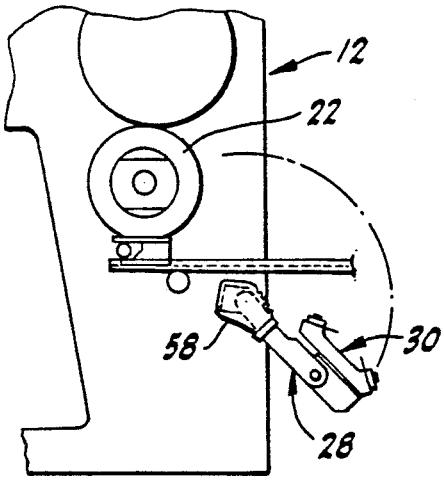
FIG. 6 is a schematic view of the flexographic press with the doctor-blade assembly actuator mechanism in a retracted position.

The guard boot 58 has a general sleeve configuration to cover and protect the stop surface 54. As shown in FIG. 4, the guard boot 58 has a configuration that provides a protective sleeve with an accordion-type corrugation 62 on the acute side of the elbow joint 52 and a smooth surface 64 on the rest of the boot with a shroud protected access port 66 for access to the fountain lock bolt 68 at the elbow joint 52 to secure the members 48 and 50 of the actuator arm 28 together. The guard boot 58 is fabricated from an elastomeric material, such as a synthetic rubber, to withstand joint lubricants and any potential solvents used in the printing process. The elasticity of the elastomer should be sufficient to enable the boot to be stretched when installed over the elbow joint. The straps 60 are of similar composition with less elasticity to maintain a firm constriction around the ends of the guard boot 58. The straps have conventional hook surface 70 that engages a pile surface 72 as shown for the peeled-back strap in FIG. 4. The design of the guard boot 58 is such that the distal member 50 can be pivoted as shown in FIG. 6 for access to the anilox roll 22 during maintenance procedures.

Figure 3:
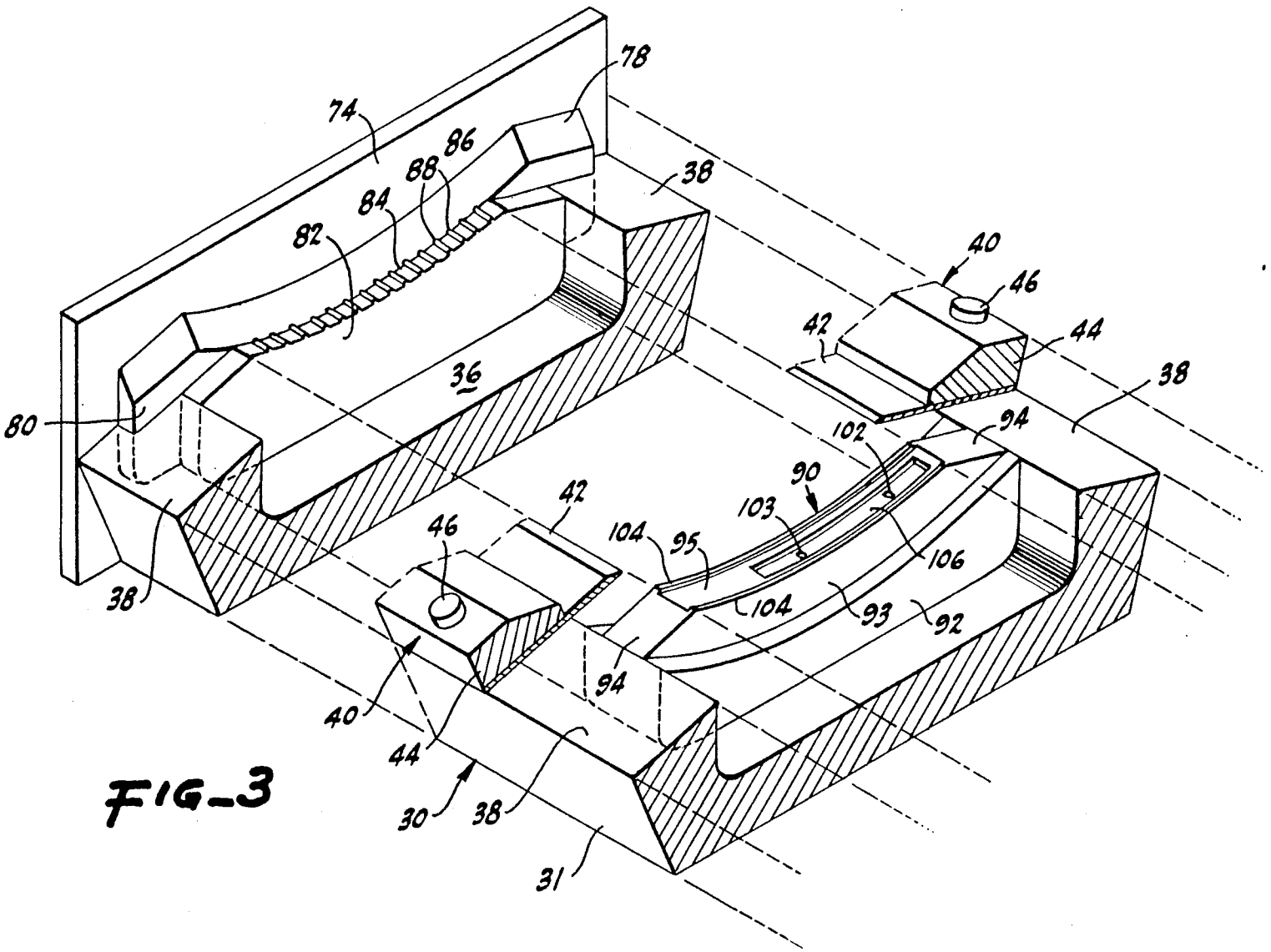
FIG. 3 is a perspective view of a portion of the ink fountain with the fountain splitter and one of the two matching end seals in position.

As shown in FIG. 3 and 4, the ink fountain 30 comprises a chamber or reservoir 36 that fills with ink when the ink fountain is positioned against the anilox roll 22 as shown in the cross sectional view of FIG. 4. The ink fountain 30 has rigid composition end plates 74 which are covered by a protective end shroud 76, shown in FIG. 2. The end plates 74 retain an end seal 78, having a flared and tapered perimeter 80 that is compressed between the end plates 74 and the end structure of the ink chamber 36 to seal ink within the chamber. Each end seal 78 also has a contoured central portion 82 that projects from the flared portion to seat partially within the chamber structure. The central portion 82 has an arcuate edge surface 84 that contacts the anilox roll when the ink fountain is in position and a sloped portion 86 at each side of the central portion that tuck under the doctor blades 42 to seal the ends of the ink fountain. The arcuate top surface preferably has transverse ridges 88 which may be orthogonal as shown or angled to channel ink on the end of the anilox roll back to the reservoir. The end seals 78 are located at each end of the ink fountain and are secured without adhesives by the end plates 74.

Figure 5:
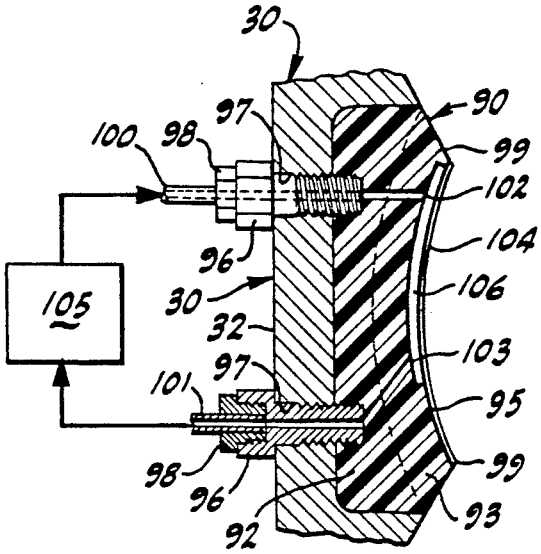
FIG. 5 is a cross sectional view of the fountain splitter shown in FIG. 2.

In a similar manner, the ink fountain splitter 90 is installed in the chamber 36 and positioned such that a portion of the splitter contacts the anilox roll when the ink fountain is in place for printing. The construction of the fountain splitter 90 is such that it has a base portion 92 that conforms to the cross-sectional configuration of the chamber 36, such that one side of the fountain splitter is sealed from the other, and a top central portion 93 with an arcuate contact surface 95 that contacts the anilox roll. The top central portion 93 has sloped ends 94 which tuck under the doctor blades 42 under slight compression to complete the seal dividing the chamber. The base portion 92 of the ink splitter 90 has spaced bores 97 and is seated on bolts 96 which act as retaining pegs for the fountain splitter. The bolts 96 are secured through the back of the base 32 of the ink fountain 30 as shown in FIGS. 4 and 5. The bolts 96 are cannulated and tapped cannulated to provide connection of a threaded end fitting 98 of a feed line 100 and a return line 101 for supply and return of an ink solvent that functions as a lubricant, preferably water, to the arcuate contact surface 95 of the fountain splitter 90.

The arcuate contact surface 95 is preferably designed with a side bead 104 along the outside edges of the contact surface. The arcuate contact surface 95 has end portions 99 and a top central portion 93. Between the end portions 99 is a a longitudinal recess 106 in the top central portion 93. The recess communicates with the feed line 100 through a supply passage 102 in the top central portion 93. A return passage 103 through the top central portion 93 returns solvent to the solvent supply 105, shown schematically in FIG. 5. The recess 106 forms a small reservoir for feed of a thin water film over a narrow segment of the surface of the anilox roller as the roller sweeps the contact surface 95 of the fountain splitter 90. The continuous sweep of the lubricated contact surface of the fountain splitter prevents ink from bleeding from one side of the fountain splitter to the other.

Both the end seals and the ink splitter are fabricated from an elastomer that is compatible with the solvent, usually water, that is used for the ink supply. The continuous squeegee action on the anilox roll which wipes the solvent film over the top surface of the ink splitter and anilox roll prevents ink from one side of the ink splitter from bleeding to the opposite side. The end seals and ink splitter are preferably fabricated from a silicone rubber having the physical characteristics of a specific gravity 1.7, Shore A hardness of 23±5, a tensile strength of 750 with 400% elongation at break and a tear resistancee of 115. The composition is available as R-1621 A/B from Silpak, Incorporated, Pomana, Calif. Adding the hardening catalyst at 10% by weight has been found to provide appropriate curing. The formed seals are flexible, closed cells with a smooth, easily lubricated surface.

Figure 7:
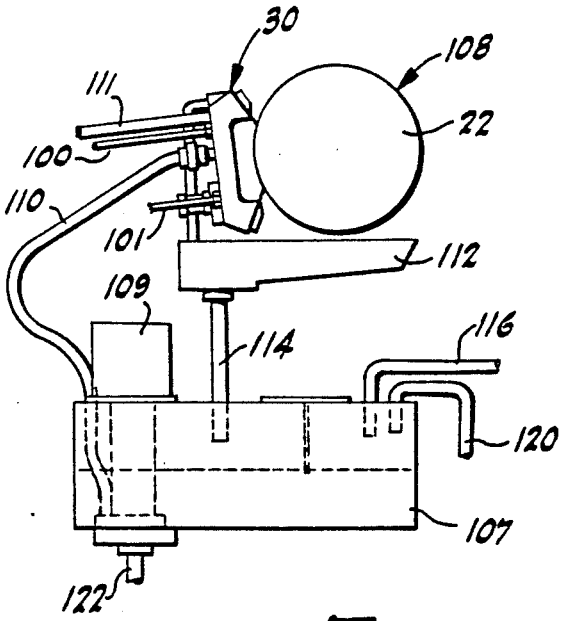
FIG. 7 is a schematic view of the flexographic press ink and solvent system.

Referring now to the schematic view of FIG. 7, an ink pack 107 under the roller assembly 108 provides a reservoir for ink that is supplied to the ink fountain 30 by a supply pump 109 through a supply line 110. Overflow line 111 returns ink from the ink fountain 30 to the ink pack 107. Ink is continually circulated throughout the ink fountain and collected by a fountain pan 112 positioned under the ink fountain and anilox roll 22 where it drains back into the ink pack 107 by the drain line 114. A solvent supply line 100 connects to the ink fountain 30 to supply lubricating water to one or more fountain splitters. The level of ink in the ink pack is maintained by a source line 116 and an overflow return line 120. Draining of the ink pack is performed through a drain line 122 which can return ink in the ink pack to the ink source (not shown) or divert cleaning solvent, usually water, to a water storage area.

While, in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. An improved doctor-blade assembly for a flexographic press having an anilox ink metering roll, the assembly comprising:

an ink fountain having an elongated tray with a base, sides and ends, forming an interior ink chamber, the sides each having a sloped mounting lip with a doctor blade and clamp means for clamping the doctor blade along the lip wherein the doctor blades are oppositely arranged on the lips, each blade having a projecting portion defining in part the formed ink chamber; and, actuator means for positioning the ink fountain in juxtaposition with the anilox roll, wherein the ends of the ink fountain tray have end plates and improved end seals fabricated from an elastomeric material, wherein the ink tray and clamped doctor blades form a cross section of the ink chamber with an irregular configuration, the end seals having a unitary construction with a contoured central portion, and a contoured flared portion, wherein the contoured central portion of the end seals projects into the ink chamber and under slight compression has a configuration conforming to the irregular cross section of the ink chamber, the central portion including an arcuate edge surface that contacts the anilox roll when the ink fountain is in position against the roll, and, wherein the contoured flared portion of the end seals extends from the central portion and seats between the end of the ink tray and the end plates when the central portion is projected into the ink chamber for sealing the ends of the ink fountain at their juncture with a rotating anilox roll.

2. The improved doctor-blade assembly of claim 1 wherein the end seals have a composition consisting of silicon rubber with a Shore A hardness of about 23.

3. The improved doctor-blade assembly of claim 1 wherein the projecting portion of the doctor blades have an inner surface and the central portion of the end seals have sloped edge segments on each side of the arcuate edge surface, wherein the sloped edge segments contact the inner surface of the projecting portion of the doctor blades.

4. The improved doctor-blade assembly of claim 3 wherein the arcuate edge surface of the central portion of the end seals has transverse ribs and the anilox roll has ends wherein the ribs channel ink on the ends of the anilox roll back to the ink chamber.

5. The improved doctor-blade assembly for a flexographic press having an anilox ink metering roll, the assembly comprising:

an ink fountain having an elongated tray with a base, sides and ends forming an interior ink chamber, the sides each having a sloped mounting lip with a doctor blade and clamp means for clamping the doctor blade along the lip wherein the doctor blades are oppositely arranged on the lips, each blade having a projecting portion defining in part the formed ink chamber; and, actuator means for positioning the ink fountain in juxtaposition with the anilox roll, wherein the ink fountain includes at least one improved fountain splitter dividing the ink chamber into multiple sections, wherein the improved fountain splitter is fabricated from an elastomer material having a composition forming a smooth, closed cell, easily lubricated surface, wherein the ink tray and clamped doctor blades form a cross section with an irregular configuration and the improved fountain splitter has a base portion that conforms to the cross sectional configuration of the chamber and a top central potion with a smooth, arcuate contact surface that contacts the anilox roll when the ink fountain is positioned against the roll, the contact surface having end portions and at one end portion a central recess with a liquid supply means for feeding a thin film of lubricant over a segment of the anilox roller as the roller sweeps the arcuate contact surface, wherein the contact surface is lubricated by the lubricant and wipes the lubricant film over the anilox roller with a squeegee action thereby preventing bleeding of ink from one section of the ink chamber separated from another section by the fountain splitter; and, wherein the fountain splitter has a composition consisting of silicone rubber with a Shore A hardness of about 23.

6. The improved doctor-blade assembly of claim 5 wherein the arcuate contact surface of the fountain splitter has outside edges with a side bead along each edge and the side beads and the top central portion of the fountain splitter are of a unitary construction.

7. The improved doctor-blade assembly of claim 5 wherein the central recess in the contact surface of the fountain splitter extends to the other end portion and includes a liquid return means for returning lubricant to a lubricant supply.

8. The improved doctor-blade assembly of claim 7 wherein the liquid supply means further includes an ink solvent lubricant passage that communicates with the recess in the contact surface for lubricating the contact surface of the fountain splitter.

9. The improved doctor-blade assembly of claim 5 wherein the fountain splitter has means for retaining the fountain splitter in the ink chamber.

10. The improved doctor-blade assembly of claim 9 wherein the retaining means includes a pair of bores in the base portion of the fountain splitter and bolts through the base of the ink fountain tray engagable in the bores.

11. The improved doctor-blade assembly of claim 10 wherein at least one bolt has a cannula and the liquid supply means has a passage for lubricating the contact surface that communicates with the cannula of the bolt.

12. The improved doctor-blade assembly of claim 11 wherein the cannula and lubrication passage connect to a lubrication supply external to the doctor-blade assembly for supplying a lubricating ink solvent to the contact surface of the fountain splitter.

13. The improved doctor-blade assembly for a flexographic press having an anilox ink metering roll, the assembly comprising:

an ink fountain having an elongated tray with a base, sides and ends, forming an interior ink chamber, the sides each having a sloped mounting lip with a doctor blade and clamp means for clamping the doctor blade along the lip wherein the doctor blades are oppositely arranged on the lips, each blade having a projecting portion defining in part the formed ink chamber; and, actuator means for positioning the ink fountain in juxtaposition with the anilox roll, wherein the actuator means has a pair of actuator arms having first and second members pivotally interconnected and forming an elbow with a mutual contact stop interface, the actuator means including an elastomeric, deformable guard boot encasing each elbow with a sleeve construction having ends with a first end strap encircling the first member of the arm and a second end strap encircling the second member of the of the arm.

14. The improved doctor-blade assembly of claim 13 wherein the guard boot has a generally smooth casing with an accordion constructed portion, wherein the elbow joint has an acute side and wherein the accordion constructed portion is positionable at the acute side of the elbow joint.

15. The improved doctor-blade assembly of claim 13 wherein the straps of the guard boots have a hook and pile connecting means for maintaining a firm connection around the ends of the boot.

16. The improved doctor-blade assembly of claim 13 wherein the ends of the ink fountain tray have end plates and improved end seals fabricated from an elastomeric material, wherein the ink tray and clamped doctor blades form a cross section of the ink chamber with an irregular configuration, the end seals having a unitary construction with a contoured central portion and a contoured flared portion, wherein the contoured central portion of the end seals projects into the ink chamber and under slight compression has a configuration conforming to the irregular cross section of the ink chamber, the central portion including an arcuate edge surface that contacts the anilox roll when the ink fountain is in position against the roll, and, wherein the contoured flared portion of the end seals extends from the central portion and seats between the end of the ink tray and the end plates when the central portion is projected into the ink chamber for sealing the ends of the ink fountain at their juncture with a rotating anilox roll.

17. The improved doctor-blade assembly of claim 16 wherein the ink fountain includes at least one improved fountain splitter dividing the ink chamber into multiple sections, wherein the improved fountain splitter is fabricated from an elastomer material having a composition forming a smooth, closed cell, easily lubricated surface, wherein the ink tray and clamped doctor blades form a cross section with an irregular configuration and the improved fountain splitter has a base portion that conforms to the cross sectional configuration of the chamber and a top central portion with a smooth, arcuate contact surface that contacts the anilox roll when the ink fountain is positioned against the roll, the contact surface having end portions and at one end portion a central recess with a liquid supply means for feeding a thin film of lubricant over a segment of the anilox roller as the roller sweeps the arcuate contact surface, wherein the contact surface is lubricated by the lubricant and wipes the lubricant film over the anilox roller with a squeegee action thereby preventing bleeding of ink from one section of the ink chamber separated from another section by the fountain splitter.

18. The improved doctor-blade assembly of claim 13 wherein the ink fountain includes at least one improved fountain splitter dividing the ink chamber into multiple sections, wherein the improved fountain splitter is fabricated from an elastomer material having a composition forming a smooth, closed cell, easily lubricated surface, wherein the ink tray and clamped doctor blades form a cross section with an irregular configuration and the improved fountain splitter has a base portion that conforms to the cross sectional configuration of the chamber and a top central portion with a smooth, arcuate contact surface that contacts the anilox roll when the ink fountain is positioned against the roll, the contact surface having end portions and at one end portion a central recess with a liquid supply means for feeding a thin film of lubricant over a segment of the anilox roller as the roller sweeps the arcuate contact surface, wherein the contact surface is lubricated by the lubricant and wipes the lubricant film over the anilox roller with a squeegee action thereby preventing bleeding of ink from one section of the ink chamber separated from another section by the fountain splitter.

* * * * *